United States Patent [19]

Van Deursen

[11] Patent Number: 4,513,761

[45] Date of Patent: Apr. 30, 1985

[54] HAIR ROLLER CLIP

[75] Inventor: Gary E. Van Deursen, Upper Saddle River, N.J.

[73] Assignee: Black & Decker, Inc., Newark, Del.

[21] Appl. No.: 593,582

[22] Filed: Mar. 26, 1984

[51] Int. Cl.[3] ..... A45D 2/26

[52] U.S. Cl. ..... 132/41; 132/46 R; 132/48 R

[58] Field of Search ..... 132/41, 46, 48, 33 RT, 132/43

[56] References Cited

U.S. PATENT DOCUMENTS 3,412,739 11/1968 Thatcher ..... 132/48 R 3,881,500 5/1975 Shinbashi ..... 132/33 B

*Primary Examiner*—Gregory E. McNeill

*Attorney, Agent, or Firm*—Paul J. Lerner

[57] ABSTRACT

A hair roller clip of a one piece self-adjusting member with components including a substantially straight base leg, a pivot connected top leg of semi-circular formation with a plurality of formed teeth, and with the base leg being a continuation of a second semi-circular formation pivot connected to the top leg. An over center spring member is pivot connected at each of its ends to the respective semi-circular leg formations on opposite sides of the connection between the leg formations. Thus, hair wound on a roller is secured so the roller clip snaps in closed hair securing and in open hair releasing positions on the roller. The entire roller clip is formed as a single integral one-piece polypropylene plastic with each pivot connection being a "living hinged" web.

6 Claims, 6 Drawing Figures

HAIR ROLLER CLIP

BACKGROUND OF THE INVENTION

1. Field of the Invention

The invention is directed to a one piece self-adjusting plastic hair roller clip of the type generally used hairpin-like to hold the user's hair clamped to a fixed or variable diameter roller. The result is an overall clip that is easily attached to and removed from any size diameter roller.

2. Description of the Prior Art

Hair clips securing hair to rollers hairpin-like are well known falling into two general types of a longitudinal clip like a bobby pin and a perpendicular clip. The longitudinal hair clip secures to a roller with its wound hair in a direction generally parallel to the longitudinal axis of the roller. This is the arrangement as used with the known bobby pin type wherein one arm of the bobby pin is disposed inside the roller and the other arm extends over the outer surface clamping the hair in place. Because of a tendency to unwind to the bobby pin it is critical that the longitudinal clip be properly positioned.

The perpendicular type clip secures itself to the roller with its wound hair on the head of the user in a direction generally perpendicular to the longitudinal axis of the cylindrical roller. The perpendicular clips are sized to match the outside diameter of a specific roller size curl and thus must match the size of the roller to avoid using the wrong size clip leading to an improperly secured roller. Further, when either clip is made of a material such as metal, it can result in permanent deforming of the hair clip after several uses.

Further, expandable diameter rollers are generally available so that one roller serves a multiple of uses and one such roller is shown in application Ser. No. 06/563091, filed Dec. 19, 1983 (6HW-5832) of common assignment.

The present invention is directed to an improvement of a hair roller clip adaptable to fixed or variable sized rollers wherein a single clip can be used with a multiplicity of roller sizes.

SUMMARY OF THE INVENTION

In accordance with the invention, a hair roller clip is provided of a one piece single integral molded plastic member of a substantially straight base leg and a connected top leg of semi-circular formation having a plurality of formed teeth interiorly thereof. The base leg is a continuation of a second semi-circular formation connected to the top leg and an over center spring member is connected at each end to the respective circular formations. The connections are all pivot or hinged connections and are web-formed living hinges. The combination is such that the clip can be snapped in to close hair-securing or open hair-releasing positions and is adaptable to any size diameter rollers. Thus, the main object is to provide an overall hair roller clip using the structure described that enables the clip to be fastened to any size diameter roller resulting in only a single clip being necessary for a multitude of rollers.

BRIEF DESCRIPTION OF THE DRAWING

Referring to FIG. 1, an outline of the cylindrical roller 10 is shown as may be used in winding the hair of the user. The roller may be a fixed diameter or, more particularly, an adjustable hair roller of the type shown in said co-pending application supra. As well known, the user's hair is wound on roller 10 and then held in place by a roller clip generally indicated at 12 of the instant invention. As such, the clip is a one piece member that preferably is made as a single integral molded polypropylene plastic or equivalent and is made up of several attached components. These components include a substantially straight base leg 14 that may be somewhat tapered as shown in FIG. 5 and may be slightly curved as seen in FIG. 1 for convenience in handling. For holding the hair around roller 10, there is provided a connected top leg 16 of generally semi-circular formation as shown. The wound hair held in place by a plurality of formed teeth 18 of any suitable shape and number on the interior surface of leg 16. Because the entire clip is a one-piece integral member, the base leg 14 has at one end a second semi-circular formation 20 which is substantially a mirror image of and is pivot-connected to top leg 16 by hinge 22. Thus, the base leg 14 is a continuation of the second semi-circular formation 20 as shown. In order to provide a biasing means for actuating about hinge 22, an over center spring member 24 is pivot-connected at each of its ends to the respective circular formations 16 and 20. As seen, spring member 24 is also semi-circular and is connected to semi-circular leg formations 20 and 16 on opposite sides of hinge 22 and substantially equally spaced therefrom as seen in FIG. 2. This arrangement provides for a toggle-like action so the clip remains in open position shown in FIG. 2 with generally no bias.

Because the entire clip has all components formed as a single integral molded one-piece polypropylene plastic, the connections between the components are all pivot connections and are web-formed "living hinge" connections generally well known. Thus, hinges 22, 26 and 28 are preferably living hinges.

Figure 1:
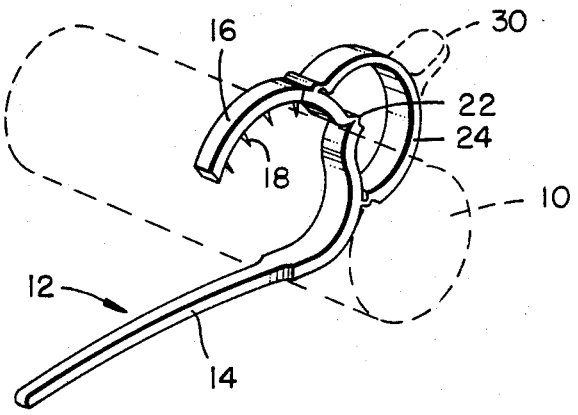
FIG. 1 is a perspective of the hair clip in position on a dotted roller.
Figure 5:
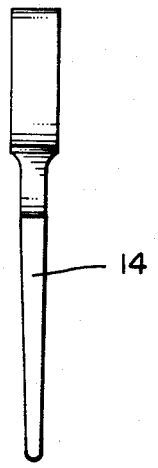
FIG. 5 is a top plan view of FIG. 1 with the clip in closed position.

An optional finger tab 30 may be provided on the over center spring 24 as shown in FIG. 1 to assist in opening and closing the clip.

Figure 2:
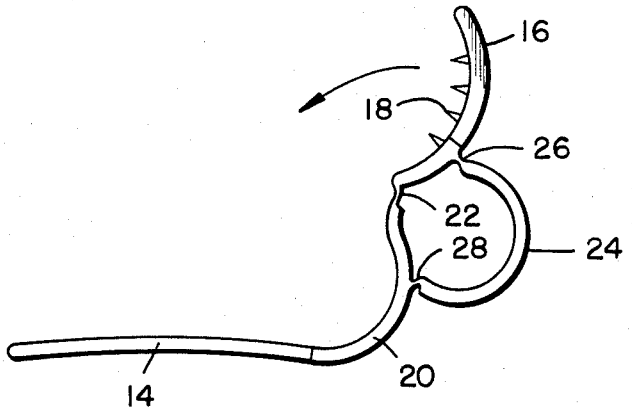
FIG. 2 is a side elevation of the clip in open position.
Figure 6:
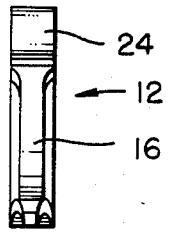
FIG. 6 is an end view of the smaller roller clip closed as shown in FIG. 4 in the direction of the arrow.
Figure 3:
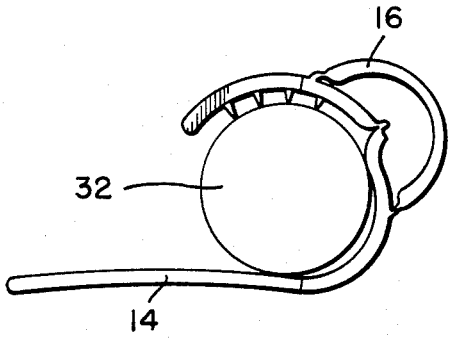
FIG. 3 is a similar view of the clip in closed position on a larger roller.
Figure 4:
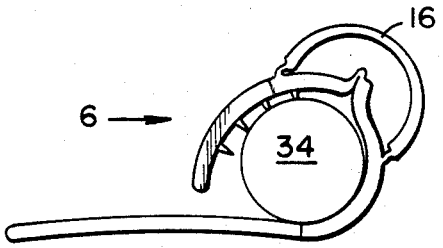
FIG. 4 is a view, similar to FIG. 3, showing the clip closed on a smaller diameter roller.

The combination of components hinged together as described, permit the clip to relax in its open position of FIG. 2 and to be closed or snapped into closed hair-securing position on a large roller 32 as shown in FIG. 3 or on a smaller roller 34 as in FIG. 4 or any in between size. The over center spring 16 ensures a tight grip with the teeth 18 gripping the hair in any one of a plurality of adjusted positions.

Thus, the present hair roller clip with its semi-circular components all joined by web-connected living hinges provides one clip to be used with any roller being self-adjusting to small, medium, or large sizes. Hair is rolled on a roller 10 in normal manner, then base leg 14 slides under the roller, and semi-circular end 20 fits around the roller whereupon the top semi-circular leg 16 is rotated toward the roller. The integral spring 24 then takes over pulling leg 16 down on the roller and holding it securely under the spring bias with teeth 18 grasping the user's hair and securing it in position as the spring snaps closed into hair securing self-adjusting positions of FIGS. 3 and 4. The reverse snap open position of FIG. 2 is the released position.

While I have hereinbefore shown a preferred form of the invention, obvious equivalent variations are possible in light of the above teachings and it is to be understood that, within the scope of the appended claims, the invention may be practiced otherwise than as specifically described, and the claims are intended to cover such equivalent variations.

I claim:

1. A hair roller clip comprising a one-piece self-adjusting member with components including a substantially straight base leg, a connected top leg of semi-circular formation with a plurality of formed teeth interiorly thereof, said base leg being a continuation of a second semi-circular formation connected to said top leg, an over center spring member connected at each end to said respective circular formations, whereby hair wound on a roller is secured in place to retain the roller on the user's head.

2. A roller clip as described in claim 1 wherein all said connections are pivot connections.

3. A roller clip as described in claim 2 wherein each of said pivot connections is a web-formed living hinge.

4. A roller clip as described in claim 3 wherein said spring is also semi-circular and web-connected at its each end to the respective semi-circular leg formations on opposite sides of the connection between said leg formations to snap into closed hair securing and open hair releasing positions.

5. A roller clip as described in claim 4 having a molded-on finger tab on said spring member.

6. A roller clip as described in claim 5 wherein the entire roller formed by all said components is a single integral molded one-piece polypropylene plastic.

* * * * *